United States Patent [19]

Yu

[11] Patent Number: 4,912,846

[45] Date of Patent: Apr. 3, 1990

[54] DISPOSABLE RAZOR

[76] Inventor: Ying Ming Yu, 4 Fl., No. 123, Sec. 1, Shin-Sheng S.Rd., Taipei, Taiwan

[21] Appl. No.: 169,947

[22] Filed: Mar. 18, 1988

[51] Int. Cl.[4] ..... B26B 21/54

[52] U.S. Cl. ..... 30/81; 30/77; 30/346.55; 30/346.57

[58] Field of Search ..... 30/81, 77, 78, 346.55, 30/346.56, 346.57, 346.61

[56] References Cited

U.S. PATENT DOCUMENTS

| | | | |
|---|---|---|---|
| 1,041,397 | 10/1912 | Wood | 30/346.56 |
| 1,238,069 | 8/1917 | Tela | 30/81 |
| 3,505,734 | 4/1970 | Iten | 30/78 |
| 3,555,682 | 1/1971 | Laszlo | 30/346.56 |
| 3,722,090 | 3/1973 | Dawidowicz | 30/81 |
| 3,797,110 | 3/1974 | Michelson | 30/82 |
| 4,211,006 | 7/1980 | Halaby et al. | 30/346.55 |

*Primary Examiner*—Douglas D. Watts
*Assistant Examiner*—Y. Lin
*Attorney, Agent, or Firm*—Fleit, Jacobson, Cohn, Price, Holman & Stern

[57] ABSTRACT

A safety razor blade has a blade body with a substantially planar upper surface. A row of blunt convex protrusions are spaced along the forward edge portion of the blade body in a comb-like configuration. The protrusions have upper surfaces substantially coplanar with the upper surface of the blade body. Cutting elements are provided between the protrusions, each cutting element having an upper surface which tapers downwardly from the upper surface of the blade body to a cutting edge. The protrusions extend beyond the respective cutting edges.

1 Claim, 1 Drawing Sheet

DISPOSABLE RAZOR

BACKGROUND OF THE INVENTION

1. A Field of the Invention

The present invention is a kind of safety razor which is disposable after use. Its feature is that at the blade of the razor, there are multiple convex protrusions which are properly sized and a surface of which is smooth and dull in a round shape. The convex protrusions are arranged in a comb like manner from one end of the razor blade to the other end. The convex protrusions protrude slightly over the sharp blade of the razor and are made in an integrated body.

2. Description of the Background Art

The present invention is a kind of safety razor which includes multiple convex protrusions which are properly sized and round in shape and installed at the blade portion of the razor and a surface of which is dull and smooth. The convex protrusions are arranged in a comb like manner from one end of the razor blade to the other end. The convex protrusions protrude slightly over the blade portion of the razor. The sharp blade portion and the convex protrusions are molded into one body and they are incorporated into one body. The convex protrusions first touch the human skin. No matter how much force is exerted on the razor, the human skin can only be in contact with the spaces between the convex protrusions on the blade of the razor because the skin is pressed by the convex protrusions of the blade. The razor can only touch the epidermis of human skin during the motion of shaving the beard, and it can not cut deep into the skin. In such a case, it will not injure the skin when one uses the safety razor in the present invention to shave the beard. It has the effect of protection of the user from being hurt by the use of the razor.

As indicated in FIG. 1, the commonly used electric razor, although it has the advantage of not scraping the skin to the extent of injury, must be equipped with a cutter subject to the restriction of combs (screen) and it has to use electricity to run the razor. Therefore, the conventional electric razor is unable to press against the skin of the person with long hair or beard to allow the hair or beard protruding into the comb to a cutting motion made by the blade of the ordinary razor. As shown in FIG. 2 the ordinary disposable razor uses a blade injector (22) of the razor blade/Double edged blade (21) to be inserted into the blade cartridge (231) of the disposable razor (23). Although that kind of razor is very convenient, without the use of electrical power, the blade edge (211) and two points of the blade (211*a*) always run deep to scrape the human skin. Further, when the razor blade/double edged blade (21) and the blade cartridge (231) of the disposable razor (23) is being separated, it always scrapes the human body too. It is considered to be unsafe in use.

In view of that, the present invention uses multiple convex protrusions which are dull and smooth in surface and in round shape, orderly arranged and projected from the razor blade in a comb shape. Its convex protrusions may press the contacted thing at first to cause the razor blade to always be unable to touch the contacted surface to a further depth. The design provides a kind of safety razor to the user.

The next purpose of the present invention is to provide a kind of safety razor which is able to shave long and short hair or beard of the people.

SUMMARY OF THE INVENTION

The present invention is a kind of safety razor which is disposable after its use. Its feature is that at the blade of the razor, there are multiple convex protrusions which are proper in size and a surface of which is smooth and dull in the round shape. Those convex protrusions are arranged in the comb type from one end of the razor blade to the other end. The convex things protrude slightly over the sharp blade of the razor and they are made in an integrated body.

DETAILED DESCRIPTION OF THE PREFERRED EMBODIMENT

A better understanding of the present invention is achieved and other features of this invention are described in detail, regarding the preferred embodiments of the invention, with reference to the drawings.

Figure 1:
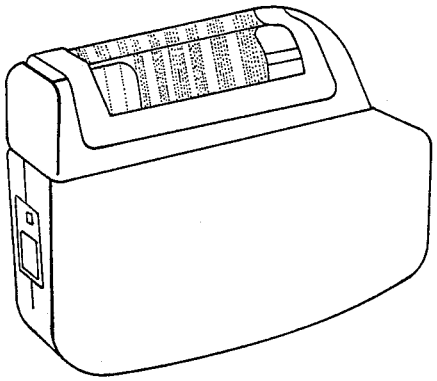
FIG. 1 (PRIOR ART)

FIG. 1 is the conventional electric razor in common practice.

Figure 2A:
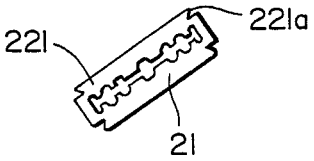
FIG. 2A (PRIOR ART)
Figure 2B:
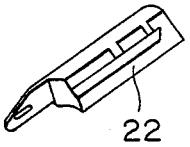
FIG. 2B (PRIOR ART)
Figure 2C:
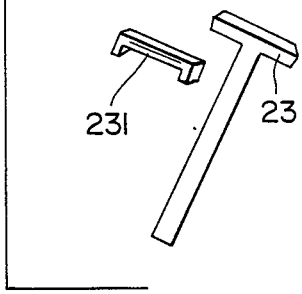
FIG. 2C (PRIOR ART)

FIGS. 2*a* and 2*b* and 2*c* are is the commonly used razor.

Figure 3A:
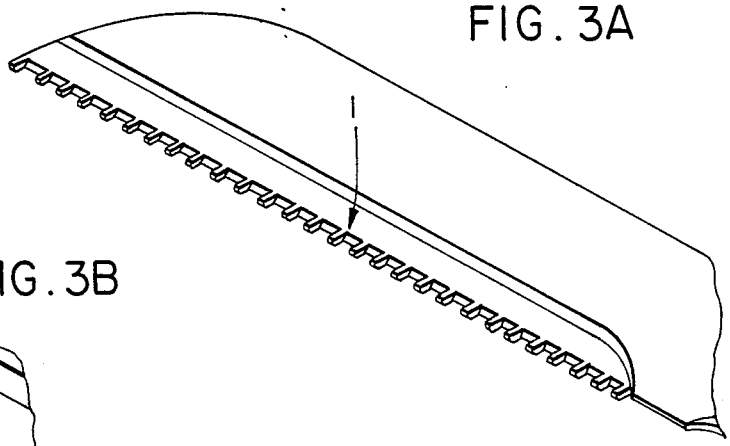
Figure 3B:
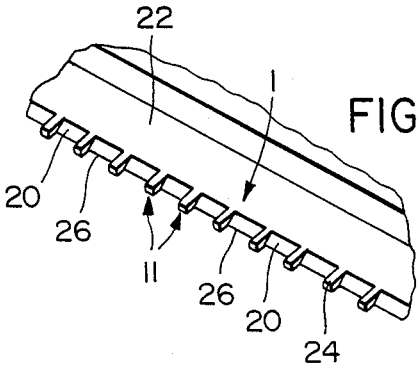

FIG. 3 is the safety razor used in the present invention.

(1) Blade

(11) Convex protrusion.

As indicated in FIG. 3, its main component is that at the blade body 1 of the razor of the multiple convex protrusions 11 which are dull and smooth in surface. Those convex protrusions 11 which are round in shape and proper in size are arranged in a comb shape form one end of the razor blade 20 to the other end. The convex things slightly protrude above the blade portion 1. The convex protrusions 11 and the sharp blade (1) are incorporated into one body. An upper surface 22 of the blade body 1 is coplanar with an upper surface 24 of the protrusions 11. An upper surface of the blade 20 tapers downwardly from the upper surface 22 of the blade body 1 and the upper surface of the protrusions 11 and terminates in a cutting edge 26. When the razor is used, the convex protrusions at first touch the human body, no matter how much force is exerted on the skin with the use of the razor. As the human skin receives the pressure from the blade 20 through the convex protrusions 11, the skin can only slightly enter into the gaps between the convex protrusions 11 of the blade 20. The blade of the razor just touches the epidemis of the human skin for the proceeding of the shaving of the hair and beard without being able to run deep into the human skin to protect the safety of the user in shaving hair or beard.

I claim:

1. A safety razor blade comprising a blade body having a substantially planar upper surface with an elongate forward edge portion, a row of blunt and smooth convex protrusions spaced along the forward edge portion in a comb-like configuration, the protrusions having upper surfaces coplanar with said upper surface of the blade body, and cutting elements located between the protrusions, each cutting element having an upper surface tapering downwardly from said upper surface of the blade body and from said upper surface of said protrusions to a cutting edge so that said upper surface of said cutting elements extends transverse to said upper surface of said blade body and extends transverse to said upper surface of said protrusions, and the protrusions extending above and beyond the respective cutting edges so that during shaving, the protrusions first contact the human skin and the skin enters the space between the protrusions to contact the cutting elements located therebetween, no matter how much force is exerted on the skin by the use of the razor.

* * * * *